US006854236B2

(12) United States Patent
Bott

(10) Patent No.: US 6,854,236 B2
(45) Date of Patent: Feb. 15, 2005

(54) REINFORCING SYSTEM FOR STACKABLE RETAINING WALL UNITS

(75) Inventor: Timothy A. Bott, Sunfish Lake, MN (US)

(73) Assignee: Allan Block Corporation, Edina, MN (US)

( * ) Notice: Subject to any disclaimer, the term of this patent is extended or adjusted under 35 U.S.C. 154(b) by 68 days.

(21) Appl. No.: 09/976,384

(22) Filed: Oct. 11, 2001

(65) Prior Publication Data

US 2003/0070385 A1 Apr. 17, 2003

(51) Int. Cl.[7] ..... E02D 29/00

(52) U.S. Cl. ..... 52/609; 52/604; 405/262; 405/284; 405/286

(58) Field of Search ..... 52/606, 607, 604, 52/561, 603, 609; 405/262, 284, 286

(56) References Cited

U.S. PATENT DOCUMENTS

| | | | | |
|---|---|---|---|---|
| RE28,977 | E | 9/1976 | Mason | |
| 4,050,254 | A | 9/1977 | Meheen et al. | |
| 4,266,890 | A | 5/1981 | Hilfiker | |
| 4,391,557 | A | 7/1983 | Hilfiker et al. | |
| 4,703,602 | A | 11/1987 | Pardo | 52/564 |
| 4,728,227 | A | 3/1988 | Wilson et al. | |
| 4,909,010 | A | 3/1990 | Gravier | |
| 4,952,098 | A | 8/1990 | Grayson et al. | |
| 5,028,172 | A | 7/1991 | Wilson et al. | |
| 5,046,898 | A | 9/1991 | McKinney | |
| 5,066,169 | A | 11/1991 | Gavin et al. | |
| 5,127,770 | A | 7/1992 | Ditcher et al. | |
| 5,326,193 | A | 7/1994 | Peterson | |
| 5,468,098 | A | 11/1995 | Babcock | |
| 5,484,235 | A | 1/1996 | Hilfiker et al. | |
| 5,487,623 | A | 1/1996 | Anderson et al. | |
| 5,507,599 | A | 4/1996 | Anderson et al. | |
| 5,522,682 | A | 6/1996 | Egan | |
| 5,551,809 | A | 9/1996 | Forsberg | |
| 5,551,810 | A | 9/1996 | Franceski et al. | |
| 5,586,841 | A | 12/1996 | Anderson et al. | |
| 5,624,211 | A | 4/1997 | Anderson et al. | |
| 5,642,968 | A | 7/1997 | Anderson et al. | |
| 5,671,584 | A | 9/1997 | Mueller | |
| 5,778,622 | A | 7/1998 | Baker | |
| 5,795,106 | A | 8/1998 | Herd | |
| 5,807,030 | A | 9/1998 | Anderson et al. | |
| 5,860,771 | A | 1/1999 | Ditcher et al. | |
| 5,921,715 | A | 7/1999 | Rainey | 405/262 |
| 5,975,810 | A | 11/1999 | Taylor et al. | 405/262 |
| 6,050,748 | A | 4/2000 | Anderson et al. | |
| 6,050,749 | A | 4/2000 | Khamis | |
| 6,079,908 | A | 6/2000 | Anderson | |
| 6,089,792 | A | 7/2000 | Khamis | |
| 6,113,317 | A | 9/2000 | Myers | |
| 6,152,655 | A | 11/2000 | Hull | |
| 6,168,351 | B1 * | 1/2001 | Rainey et al. | 405/262 |
| 6,224,295 | B1 | 5/2001 | Price et al. | 405/262 |
| 6,238,144 | B1 | 5/2001 | Babcock | |
| 6,338,597 | B1 | 1/2002 | Rainey | |
| 2001/0014255 | A1 | 8/2001 | Orsat | 405/15 |

* cited by examiner

*Primary Examiner*—Carl D. Friedman
*Assistant Examiner*—Nahid Amiri
(74) *Attorney, Agent, or Firm*—Fredrikson & Byron, P.A.

(57) ABSTRACT

A stablized retaining wall structure comprising concrete blocks stacked in an array of superimposed rows, and with a stable anchoring assembly being in restraining contact with selected blocks. An access bore extends from the rear surface of the block to the surface of the wall comprising the hollow core. An earthen fill zone is arranged in spaced apart relationship to the rear surface of the wall and clean granular back-fill is interposed between the wall and the earthen fill zone. A keeper device is provided to couple selected wall blocks to the stable anchoring assembly, with the keeper device being configured to be restrainably held within the hollow core. An elongated fastener is coupled to the keeper device, with the fastener extending through the access bore and secured to the stable anchoring assembly.

12 Claims, 4 Drawing Sheets

REINFORCING SYSTEM FOR STACKABLE RETAINING WALL UNITS

BACKGROUND OF THE INVENTION

The present invention relates generally to an improved system for stabilizing retaining wall structures, and particularly retaining wall structures which comprise a plurality of individual blocks stacked in an array of superimposed rows. More particularly, the present invention relates to improved connector devices which provide and facilitate attachment between selected individual blocks and a remotely positioned stable anchoring assembly. By way of explanation, the stable anchoring assembly may typically be in the form of a geogrid, mesh, deadman, or the like, with the anchoring assembly normally being disposed in on-site soils which typically contain corrosion inducing salts and the like.

Retaining walls are in general use for a wide variety of applications, including virtually any application where it is necessary to hold or retain earth to prevent erosion or undesired washing of a sloped surface or for general landscaping purposes. Examples of such applications further include retaining walls designed for configuring contours for various landscaping projects, as well as those for protecting surfaces of roadways, walkways, or the like from eroded soil and earth. Because of their physical structure and for protection of the wall from excessive hydrostatic pressures, the wall is normally separated from on-site soils by a buffer zone of clean granular backfill, such as, for example, crushed rock, binder rock, or the like. Such buffer zones assist in drainage, while at the same time assist in reducing hydrostatic pressure against the wall.

In order to achieve proper stabilization of the erected retaining wall, a geogrid, deadman, wire mesh system, or other anchoring means buried remotely from the retaining wall and disposed within the on-site soil is utilized to positionably stabilize, hold, or otherwise restrain individual blocks or groups of blocks forming the array against movement or motion. Selected blocks comprising the wall are coupled to the anchoring means. Various forms of coupling means have been utilized in the past, they have typically been designed to be captured within the block structure, and thereafter fixed directly to the anchoring means. Little, if any, length adjustment has been possible in the coupling means, thereby making the interconnection less than convenient. As such, the ultimate interconnecting operation can be time consuming due to the necessity of configuring coupling means to fit the block wall. Also in those coupling devices which are permanently fixed to the block, pallet stacking densities of blocks to be shipped may be reduced. The present invention facilitates the interconnection process by utilizing a coupling means which includes a standard keeper frame together with elongated couplers of adjustable or assorted lengths. Individual blocks comprising the retaining wall structure are provided with a hollow core along with an access bore extending from the rear block surface to the inner wall of the core. This arrangement makes it possible to utilize a single block structure which may be tightly palletized as any standard block design, with the block having a structure which facilitates secure attachment of the coupling means to individual blocks, with the coupling means being, in turn, produced conveniently in selective and appropriate lengths for ready attachment or fastening to the stable anchoring assembly.

SUMMARY OF THE INVENTION

In accordance with the present invention, a coupling means for securing individual blocks in a retaining wall to a stable remote anchoring assembly. The coupling means includes a keeper device with an elongated fastener having one end secured to the keeper frame, and with the opposed end being linked to the anchoring assembly. The individual blocks are hollow core structures having bores extending from the rear wall surface through the web of the block into the hollow core. The keeper assemblies are designed to receive and retain the elongated fastener therewithin. The keeper frame is sized for retention within the block core, while various lengths of fasteners are provided to achieve and facilitate the interconnection between individual blocks and the stable anchoring assembly. The fasteners may be length adjustable in order to facilitate or accommodate taut or tight interconnects. In this fashion, a stabilized retaining wall is formed with a universal coupler means being provided, the coupling means employing a standard keeper frame along with elongated couplers of a variety of lengths.

Therefore, it is a primary object of the present invention to provide an improved interconnection between individual blocks in a retaining wall structure and a remotely positioned or disposed stable anchoring assembly.

It is yet a further object of the present invention to provide an improved interconnection system for use in joining individual blocks of a retaining wall to a remotely positioned stable anchoring assembly such as, for example, a geogrid, wire mesh, or dead-man.

Other and further objects of the present invention will become apparent to those skilled in the art upon a study of the following specification, appended claims, and accompanying drawings.

IN THE DRAWINGS

Figure 6:
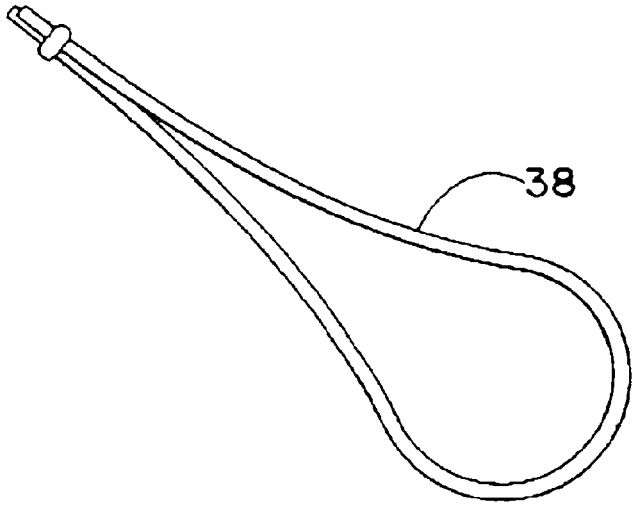
Figure 7:
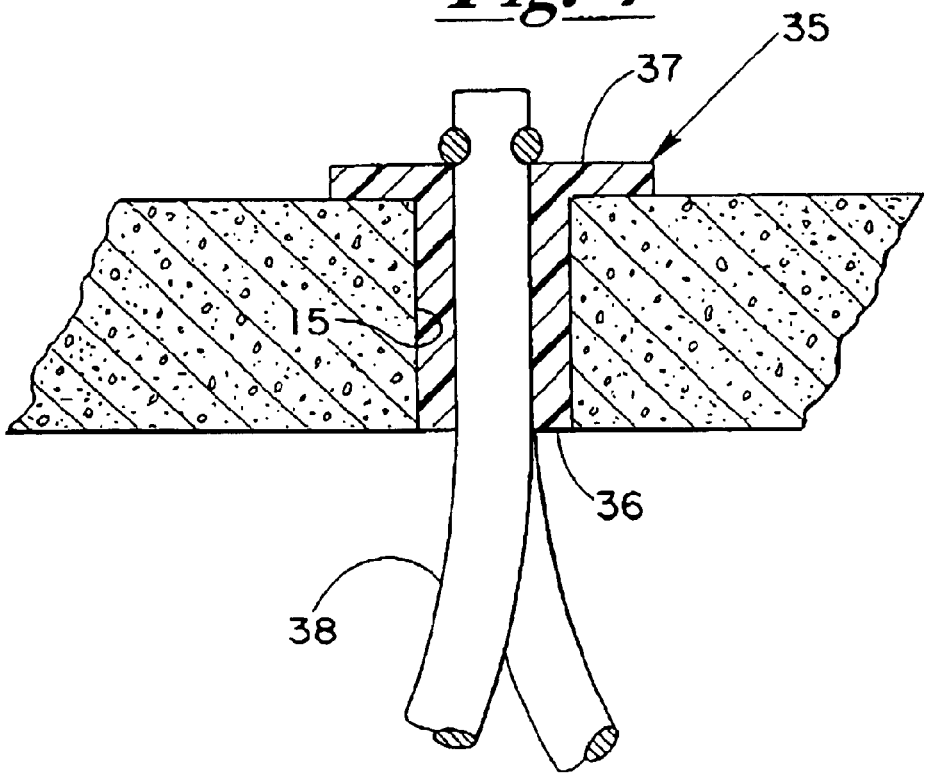

FIG. 6 is a detail elevational view of a further alternative embodiment of the coupling means and illustrating an elongated fastener being slidably engaged within a stopper element, with a portion of the elongated fastener being cut away; and FIG. 7 is a horizontal sectional view illustrating the arrangement detail of the locking sleeve utilized to retain the elongated fastener within the block structure.

DESCRIPTION OF A FIRST PREFERRED EMBODIMENT

Figure 1:
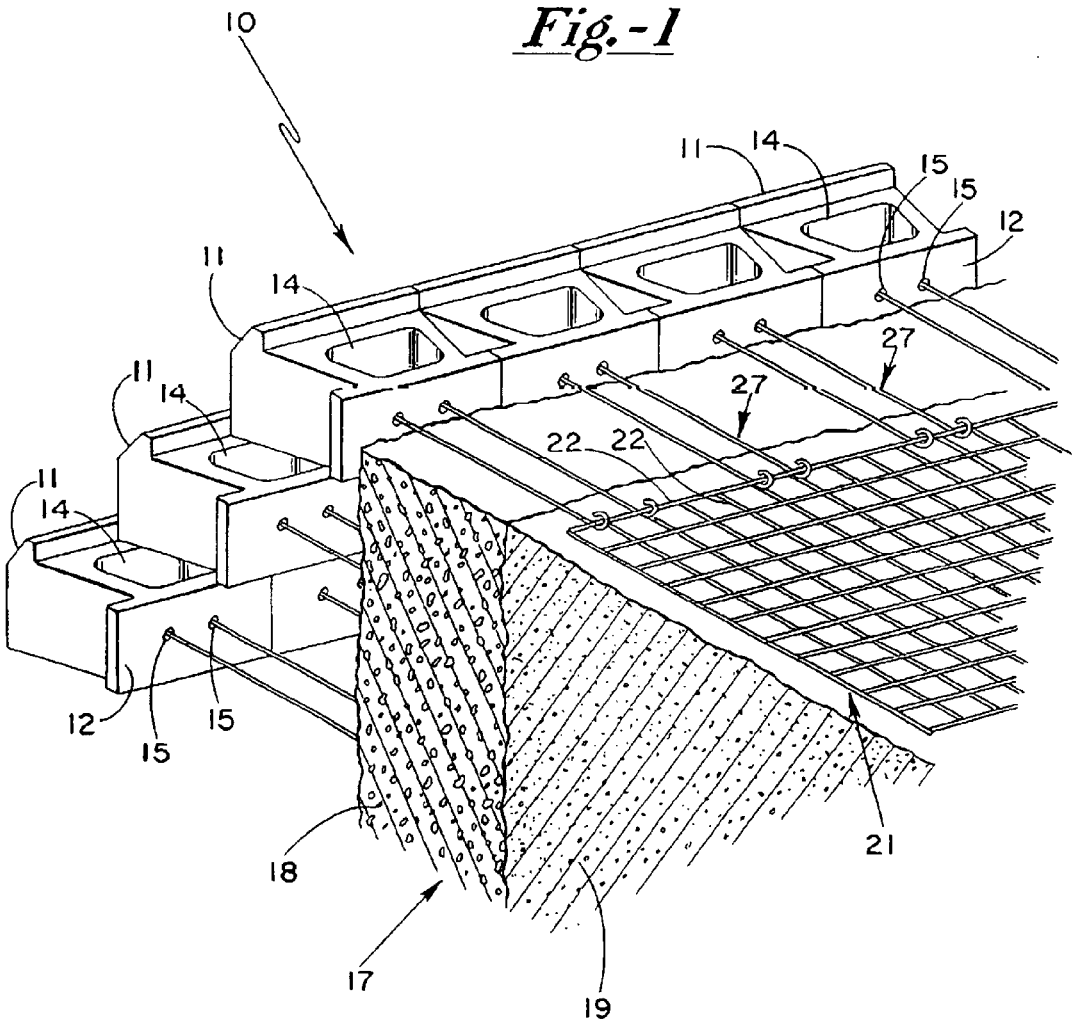
FIG. 1 is a perspective view of a stabilized retaining wall structure with a portion of the retaining wall being shown along a vertical sectional view.
Figure 2:
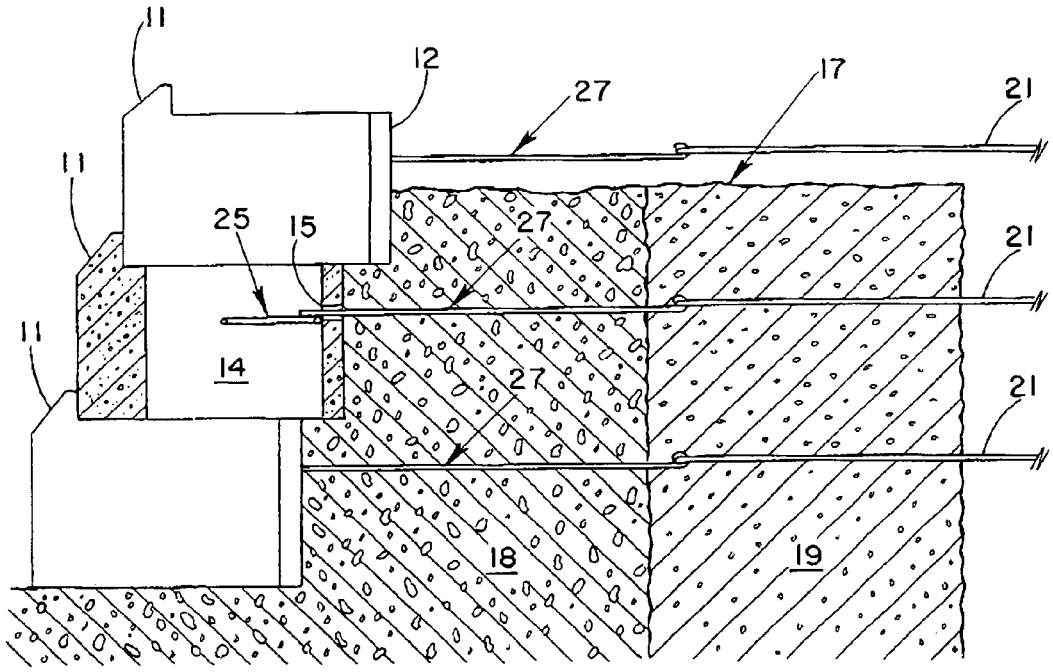
FIG. 2 is an end elevational view of a retaining wall block of the type illustrated in FIG. 1, and illustrating in phantom the disposition of the coupling means as attached to a stable anchoring assembly.

In accordance with one preferred embodiment of the present invention, and with particular attention being directed to FIG. 1 of the drawings, the stabilized retaining structure generally designated 10 comprises a plurality of individual blocks 11-11 which are arranged in a plurality of superimposed rows to form a stacked array. Each of the blocks 11 has a rear surface 12 with a hollow core 14 being formed in at least selected of blocks 11. Retaining wall blocks of this configuration and/or form are known in the art.

Blocks 11 are provided with an access bore 15 which extends through the block from the rear surface to the surfaces of the wall comprising the hollow core. As further indicated in FIG. 1, a rock and earthen fill such as is illustrated generally at 17 is in contact with the rear surfaces 12 of the blocks 11, with fill 17 comprising a pair of individual or separate layers. The first layer 18 positioned adjacent wall 10 is preferably clean granular backfill, such as clean crushed rock or binder rock. The more remote layer 19 consists of on-site soils such as, for example, black earth, typically containing quantities of clay and salt. A stable anchoring assembly shown generally at 21 is disposed within the on-site soil, with assembly 21 being comprised of individual geogrid members shown at 22—22. Alternative forms of anchoring assemblies may be employed in lieu of geogrids 22, such as for example, steel, mesh, deadman, or the like.

In as much as the on-site soils typically contain moisture and salts, galvanic or electrolytic corrosion typically occurs within metallic components buried or otherwise immersed in the soil. The galvanic corrosive action is accelerated and/or supported if the on-site soils are permitted to make contact with the rear surfaces of the individual blocks, with the area adjacent the blocks being characterized as the "corrosive front". Thus, deterioration of any metallic components disposed in close proximity to the interface between the block wall and on-site soils may suffer rapid deterioration. In order to reduce the level of activity of the corrosive front, and increase the life of metallic components disposed therearound, the utilization of clean granular fill has been found to be helpful but never sufficient to eliminate the problem. However, because of the nature of certain soils, taken together with the salts present in the individual blocks, coupling means may be provided to link individual blocks to the stable anchoring assembly which are non-metallic and thus generally immune from corrosive action. In these situations, there remains a need for clean granular backfill, particularly for reduction and/or elimination of hydrostatic forces which may otherwise develop if saturated on-site soils are permitted to remain in contact with the retaining wall structure. In accordance with the present invention, however, the retaining wall is provided with additional stabilizing features through the utilization of coupling means which conveniently link the blocks to a remotely disposed stable anchoring assembly.

Figure 3:
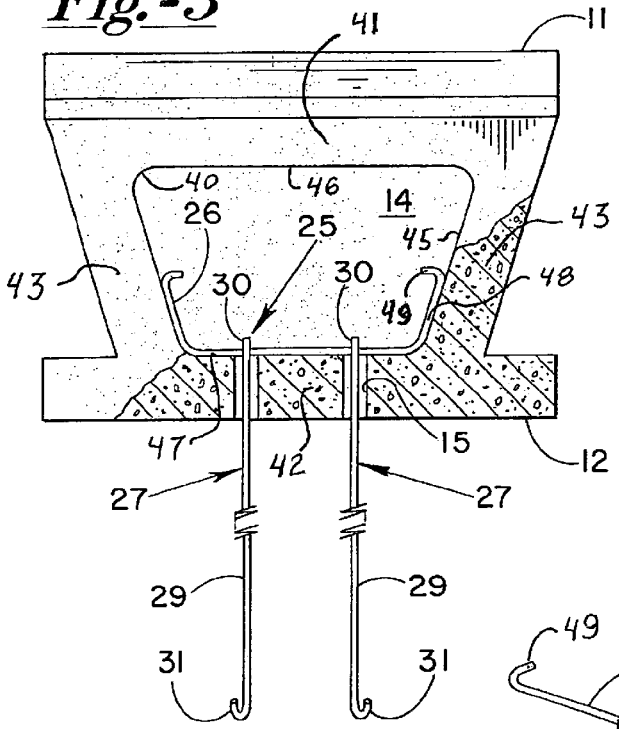
FIG. 3 is a top plan view of a block structure of the type illustrated in FIG. 1, and further showing one embodiment of the coupling means of the present invention in position within the core of the block.
Figure 4:
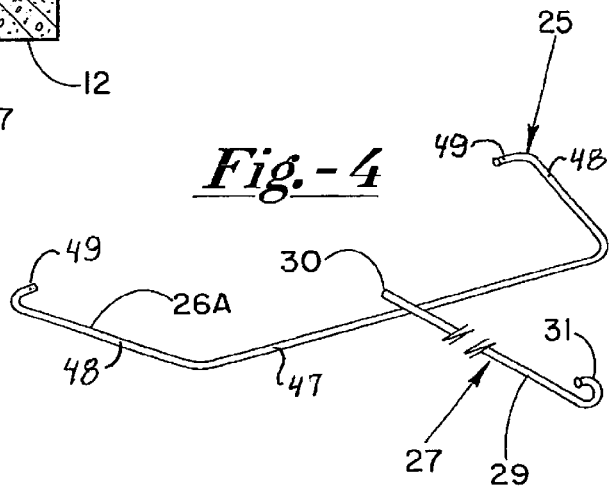
FIG. 4 is a detail perspective view of one preferred embodiment of the coupling means of the present invention.

With attention now being directed to FIGS. 3 and 4 of the drawings, the coupling means generally designated 25 comprises a keeper device 26 to which there are attached a pair of elongated fasteners as shown generally at 27—27 (see FIG. 3). In the alternative arrangement of FIG. 4, keeper device 26A is provided with a single fastener 27.

Each fastener 27 has a proximal end 30 and a distal end 31 comprises a central body segment 29 interposed between the proximal and distal ends. Body segment 29 extends through and distally of block 11, passing through access bore 15 formed in the rear web of block 11. Distal end 31 is configured to engage or otherwise be secured to a suitable anchoring point in one of the geogrids 22—22. Thus, distal end 31 comprises an anchoring assembly attachment means.

Figure 5:
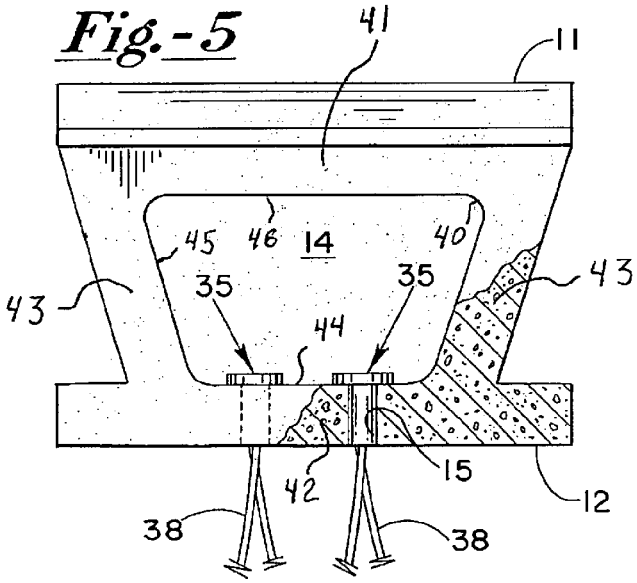
FIG. 5 is a view similar to FIG. 3, and illustrating an alternate form of coupling means secured within the block structure.

With attention now being directed to FIGS. 5 and 7 of the drawings, plastic sleeve generally designated 35 is provided, with sleeve 35 comprising a tubular segment 36 and a flanged segment 37, with flange segment 37 being sized so as to be larger than the diameter of access bore 15. Means are provided to restrain elongated fastener means 38 within plastic sleeve 35 by means of suitable retainers along the proximal end 30 of fastener 27. In the embodiment illustrated in FIGS. 5 and 7, elongated fastener 38 is in the form of reinforced flexible line or cable, which may conveniently consist of a non-metallic plastic resinous material such as nylon, or alternatively, steel cable. The utilization of sleeve 35 provides protection to the cable from abrasion which may otherwise be created through rubbing contact or other interaction with the concrete. The outer diameter of tubular segment 36 is, of course, sized to pass through access bore 15 while the flanged end is sufficiently large so as to be retained within core 14.

In those situations where the distance between the rear surface of the block wall and the anchoring assembly may vary, elongated fastener means 27 may more conveniently consist of a material such as reinforced nylon, which may be knotted and/or otherwise formed to length, whereby convenient attachment to geogrid or steel mesh may be achieved. In order to accommodate random length requirements of the fastener means, one convenient technique is to loop a length of line from the keeper device through an opening in the geogrid (or mesh) and then back to and through access bore 15, whereby the proximal end may be secured by a cable clamping device for a cable or a knot arrangement for materials such as reinforced nylon.

Thus, it will be observed that the coupling means of the present invention provide a simple means by which a hollow cored block may be positively connected to a stable anchoring assembly. Additionally, the coupling means may be used in a variety of applications from steel ladder reinforced soil structures to positive connections with geogrid reinforcements, certain soil nails may be used as well. The connection means resist localized corrosion without requiring use of costly components such as those fabricated from stainless steel, coated or hot-dipped high carbon steel, or the like. Galvanic protection is readily achieved, along with versatility of coupling length.

As shown in FIGS. 1, 3, 4, and 5, a selected block 11 includes at least one hollow core 14 and a rear surface 12. The selected block includes a front web portion 41, a rear web portion 42, and a pair of side web portions 43 interconnecting the front 41 and rear web 42 portions. The rear web portion 42 of said selected block includes an access bore 15 formed therein such that said hollow core 14 can be accessed from the rear surface 12 of said selected block. The selected block 11 further includes an inner surface 40. The inner surface 40 includes a rear inner surface portion 44 defined by the rear web portion 42, side inner surface portions 45 defined by the side web portions 43, and a front inner surface portion 46 defined by the front web portion 41. The keeper 26, which may be referred to as the metal bracket or metal bracket of the keeper, engaged in the hollow core 14 of the selected block 11 may be a metal bracket structured to include a rear bracket portion 47 confronting the rear inner surface portion 44 of the rear web portion 42 of the selected block 11 and a pair of side bracket portions 48 confronting the side inner surface portions 45 of the side web portions 43 of the selected block 11. A pair of elongated connectors 27 run from the metal bracket 26. Each of the elongated connectors 27 includes a body segment 29 and opposed proximal 30 and distal ends 31. The proximal end 30 of each of the elongated connectors 27 is engaged with the rear bracket portion 47 of the metal bracket 26. Each of the elongated connectors 27 is in one respective access bore 15 of the rear web portion 42 of the selected block 11 and runs from the access bore 15. The distal end 31 of the elongated connector 27 includes an anchoring assembly attachment means that includes a hook. The metal bracket 26 further includes a pair of end bracket portions 49. Each of the end bracket portions 49 runs inwardly from one respective side bracket portion 48. The hollow core 14 is partially defined by tapered side web portions 43 tapering inwardly from a front web portion 41 of said selected block 11 to a rear web portion 42 of said selected block 11.

It will be appreciated that various modifications may be made to the techniques of the present invention, it being further understood that the examples given herein are for purposes of illustration only and are not to be construed as a limitation upon the scope to which the invention is otherwise entitled.

What is claimed is:

1. A stabilized retaining wall structure comprising:

a) a plurality of individual blocks stacked in an array of superimposed rows, with at least one hollow core being formed in selected blocks of said individual blocks, with said selected block comprising a rear surface and an access bore, with said access bore running from said rear surface to said hollow core such that said hollow core can be accessed from a rear of said selected block;

b) an earthen fill zone in spaced apart relation to said rear surfaces of said selected blocks;

c) clean granular back-fill interposed between said earthen fill zone and said rear surfaces of said selected blocks;

d) a stable anchoring assembly disposed in said earthen fill zone and being coupled to and in restraining contact with said selected blocks;

e) a keeper engaged in the hollow core of said selected block; and f) an elongated connector running between said keeper and said stable anchoring assembly, with the elongated connector comprising a body segment and opposed proximal and distal ends, with said proximal end of said elongated connector being engaged with said keeper, with the elongated connector being in the access bore of said selected block and running from the access bore of said selected block, with said distal end comprising an anchoring assembly attachment means, with said anchoring assembly attachment means being secured to said stable anchoring assembly.

2. The stabilized retaining wall structure of claim 1:

a) wherein said selected block comprises a front web portion, a rear web portion, and a pair of said web portions interconnecting the front and rear web portions;

b) wherein said selected block further comprises an inner surface, wherein said inner surface comprises a rear inner surface portion defined by the rear web portion, side inner surface portions defined by the side web portions, and a front inner surface defined by the front web portion; and c) wherein said keeper comprises a metal bracket structured to include a rear bracket portion confronting the rear inner surface portion of said rear web portion of said selected block and a pair of side bracket portions confronting the side inner surface portions of said side web portions of said side web portions of said selected block.

3. The stabilized retaining wall structure of claim 1:

a) wherein said selected block includes another access bore;

b) wherein said stabilized retaining wall structure further comprises another elongated connector, with the proximal ends of each of the elongated connectors being engaged to said keeper, with each of the elongated connectors being in one respective access bore, and with each of the anchoring assembly attachment means of the distal ends of the elongated connectors being secured to a respective portion of said stable anchoring assembly.

4. The stabilized retaining wall structure of claim 1, wherein said distal end of the elongated connector comprises a hook.

5. The stabilized retaining wall structure of claim 3, wherein each of the distal ends of the elongated connectors comprises a hook.

6. The stabilized retaining wall structure of claim 1, wherein said hollow core is partially defined by tapered said web portions tapering inwardly from a front web portion of said selected block to a rear web portion of said selected block.

7. The stabilized retaining wall structure according to claim 2, wherein said metal bracket further comprises a pair of end bracket portions, with each of the end bracket portions running inwardly from one respective side bracket portion.

8. A stabilized retaining wall structure comprising:

a) a plurality of individual blocks stacked in an array of superimposed rows, with at least one hollow core being formed in selected blocks of said individual blocks, with said selected block including a rear surface;

b) with said selected block further comprising a front web portion, a rear web portion, and a pair of side web portions interconnecting the front and rear web portions;

c) with said rear web portion of said selected block comprising an access bore formed therein such that said hollow core can be accessed from the rear surface of said selected block;

d) with said selected block further comprising an inner surface, wherein said inner surface comprises a rear inner surface portion defined by the rear web portion, side inner surface portions defined by the side web portions, and a front inner surface portion defined by the front web portion;

e) an earthen fill zone in spaced apart relation to said rear surfaces of said selected blocks;

f) a clean granular back-fill interposed between said earthen fill zone and said rear surfaces of said selected blocks;

g) a stable anchoring assembly disposed in said earther fill zone for being coupled to and in restraining contact with said selected blocks;

h) a keeper engaged in the hollow core of said selected block, wherein said keeper comprises a metal bracket structured to include a rear bracket portion confronting the rear inner surface portion of said rear web portion of said selected block and a pair of side bracket portions confronting the side inner surface portions of said side web portions of said selected block; and i) a pair of elongated connectors running between said metal bracket and said stable anchoring assembly, with each of said elongated connectors comprising a body segment and opposed proximal and distal ends, with said proximal end of each of said elongated connectors being engaged with the rear bracket portion of said metal bracket, with each of said elongated connectors being in one respective access bore of said rear web portion of said selected block and running from said access bore, with said distal end comprising an anchoring assembly attachment means that comprises a hook, and with said anchoring assembly attachment means being secured to said stable anchoring assembly.

9. The stabilized retaining wall structure according to claim 8, wherein said metal bracket further comprises a pair of end bracket portions, with each of the end bracket portions running inwardly from one respective side bracket portion.

10. A stabilized retaining wall structure comprising:

a) a selected block comprising at least one hollow core and a rear surface;

b) with said selected block further comprising a front web portion, a rear web portion, and a pair of side web portions interconnecting the front and rear web portions;

c) with said rear web portion of said selected block comprising an access bore formed therein such that said hollow core can be accessed from the rear surface of said selected block;

d) with said selected block further comprising an inner surface, wherein said inner surface comprises a rear inner surface portion defined by the rear web portion, side inner surface portions defined by the side web portions, and a front inner surface portion defined by the front web portion;

e) a keeper engaged in the hollow core of said selected block, wherein said keeper comprises a metal bracket structured to include a rear bracket portion confronting the rear inner surface portion of said rear web portion of said selected block and a pair of side bracket portions confronting the side inner surface portions of said side web portions of said selected block; and f) a pair of elongated connectors running from said metal bracket, with each of said elongated connectors comprising a body segment and opposed proximal and distal ends, with said proximal end of each of said elongated connectors being engaged with the rear bracket portion of said metal bracket, with each of said elongated connectors being in one respective access bore of said rear web portion of said selected block and running from said access bore, and with said distal end comprising an anchoring assembly attachment means that comprises a hook.

11. The stabilized retaining wall structure according to claim 10, wherein said metal bracket further comprises a pair of end bracket portions, with each of the end bracket portions running inwardly from one respective side bracket portion.

12. A stabilized retaining wall structure connector apparatus comprising:

a) a keeper, wherein said keeper comprises a metal bracket structured to include a rear bracket portion, a pair of side bracket portions running inwardly from one respective side bracket portions; and b) a pair of elongated connectors running from said metal bracket, with each of said elongated connectors comprising a body segment and opposed proximal and distal ends, with said proximal end of each of said elongated connectors being engaged with the rear bracket portion and running from said rear bracket portion, and with said distal end comprising a hook.

* * * * *